United States Patent [19]

Yoshino et al.

[11] Patent Number: 4,980,028

[45] Date of Patent: Dec. 25, 1990

[54] METHOD OF CONTROLLING FUEL FOR A COKE OVEN

[75] Inventors: Yoshio Yoshino; Koji Tsuchihashi; Yoshihiro Omae; Kenzo Tsujikawa, all of Kitakyushu; Yukio Yamaguchi, Kawasaki, all of Japan

[73] Assignee: Mitsubishi Kasei Corporation, Tokyo, Japan

[21] Appl. No.: 815,181

[22] Filed: Dec. 23, 1985

Related U.S. Application Data

[63] Continuation of Ser. No. 594,974, Mar. 29, 1984, abandoned.

[30] Foreign Application Priority Data

Mar. 29, 1983 [JP] Japan ..... 58-53179

[51] Int. Cl.[5] ..... C10B 47/00

[52] U.S. Cl. ..... 201/1; 201/41; 201/44

[58] Field of Search ..... 201/1, 41, 44

[56] References Cited

U.S. PATENT DOCUMENTS

| | | | |
|---|---|---|---|
| 3,607,660 | 9/1971 | Kumper | 201/1 |
| 4,045,292 | 8/1977 | Matsushita et al. | 201/1 |
| 4,064,017 | 12/1977 | Beck et al. | 201/1 |
| 4,086,143 | 4/1978 | Eckterhoff et al. | 201/41 |

FOREIGN PATENT DOCUMENTS

| | | | |
|---|---|---|---|
| 0056166 | 7/1982 | European Pat. Off. . | |
| 0081246 | 6/1983 | European Pat. Off. | 201/1 |
| 57-159877 | 10/1982 | Japan | 201/1 |
| 563037 | 7/1944 | United Kingdom . | |
| 644203 | 10/1950 | United Kingdom . | |
| 677398 | 8/1952 | United Kingdom . | |
| 1135307 | 12/1968 | United Kingdom . | |
| 1486363 | 9/1977 | United Kingdom . | |

*Primary Examiner*—Peter Kratz

*Attorney, Agent, or Firm*—Oblon, Spivak, McClelland, Maier & Neustadt

[57] ABSTRACT

A method fo controlling fuel for a coke oven by a programmed heating method in which the fuel supply rate is changed at least once during the coal carbonization process in the coke oven, wherein the improvement comprises conducting the substantial reduction of the fuel supply rate from a large flow rate at the initial stage of the carbonization to a small flow rate inclusive of a zero rate when the coal center temperature, i.e. the temperature at the center of the coal packed in the carbonization chamber, is within a range of from 350° to 700° C.

6 Claims, 4 Drawing Sheets

METHOD OF CONTROLLING FUEL FOR A COKE OVEN

This application is a continuation of application Ser. No. 594,974, filed Mar. 29, 1984, now abandoned.

The present invention relates to a method of controlling fuel for a coke oven.

As an energy saving measure for a coke oven, a so-called programmed heating method has been proposed wherein the supply rate of fuel to the coke oven is set to be a large flow rate at the initial stage of the carbonization and then adjusted to a proper supply rate depending upon the particular purpose of each of the subsequent stages. Namely, in this method, the fuel supply rate is maintained at a level of from 1.6 to 2.5 times the supply rate in the case of a regular heating method, up to 3 to 9 hours after the initiation of carbonization, and then switched, 1 to 3 times, to a small flow rate inclusive of a zero rate.

However, this method has a drawback that the coke strength after reaction (CSR) of the coke thereby obtained, is low although the heat consumption for carbonization can be reduced to some extent. For this reason, this method has not yet been practically used.

Under these circumstances, the present inventors have conducted extensive studies on the relationship between the heating pattern in the programmed heating method and the coke strength after reaction (CSR) thereby obtained with an aim to overcome the above-mentioned drawback. As a result, it has been found that the timing for the substantial reduction of the supply rate of the fuel from the large flow rate to a small flow rate inclusive of a zero rate is important. Namely, in the conventional method, the temperature at the center of the coal packed in the carbonization chamber (hereinafter referred to simply as the coal center temperature) used to be from about 100° to about 200° C. at the time of the first switching of the supply rate of fuel. Whereas, it has now been found that if the substantial reduction of the fuel supply rate is conducted when this coal center temperature is within a range of from 350° to 700° C., it is possible to obtain coke having superior coke strength after reaction. The present invention has been accomplished based on this discovery.

Thus, the present invention provides a method of controlling fuel for a coke oven by a programmed heating method in which the fuel supply rate is changed at least once during the coal carbonization process in the coke oven, wherein the improvement comprises conducting the substantial reduction of the fuel supply rate from a large flow rate at the initial stage of the carbonization to a small flow rate inclusive of a zero rate when the coal center temperature, i.e. the temperature at the center of the coal packed in the carbonization chamber, is within a range of from 350° to 700° C.

Further, it is possible to more precisely control the fuel supply rate by determining the coal center temperature for the substantial reduction of the fuel supply rate, taking the operation ratio of the coke oven into consideration.

Now, the present invention will be described in detail with reference to the preferred embodiments.

In the accompanying drawings, FIG. 1 illustrates heating patterns of a coke oven.

In the programmed heating method employed in the present invention, the fuel supply at the initial stage of the carbonization of coal is set to be a large flow rate in order to rapidly raise the temperature of the coal filled in the carbonization chamber, and the large flow rate is preferably at least about 1.2 times the fuel supply rate in the case of a regular heating method. The greater the supply rate, the better. However, the supply rate should be restricted within a range where no substantial adverse effects to the coke oven structure such as the refractory bricks will be brought about by the high temperature or local heating. Practically, this large flow rate is determined depending upon the structure of the oven or the combustion system employed, but it is selected usually within a range of from 1.2 to 3 times, preferably from 1.3 to 2.3 times, the supply rate in the case of a usual regular heating method. Of course, this flow rate may not necessarily by constant. For instance, if the calorie of the fuel gas varies, the variation may be compensated by adjusting the flow rate.

The small flow rate inclusive of a zero rate is meant for a fuel supply rate within a range from about 0.3 time the supply rate in the case of a regular heating method to the complete termination of the fuel supply.

The term "substantial reduction of the fuel supply rate" used in this specification, is meant for the reduction of the fuel supply rate from the above-defined large flow rate to the above-defined small flow rate.

It is important to conduct the substantial reduction of the fuel supply rate to the small flow rate inclusive of a zero rate when the above-mentioned coal center temperature is within a range of from 350° to 700° C., preferably from 400° to 650° C.

If the coal center temperature is less than 350° C. at the time of the substantial reduction, the coke strength after reaction will be inadequate. On the other hand, if the coal center temperature is higher than 700° C., the reduction rate of the consumption required for the carbonization will be low, whereby the merit of the programmed heating will be lost.

Figure 3:
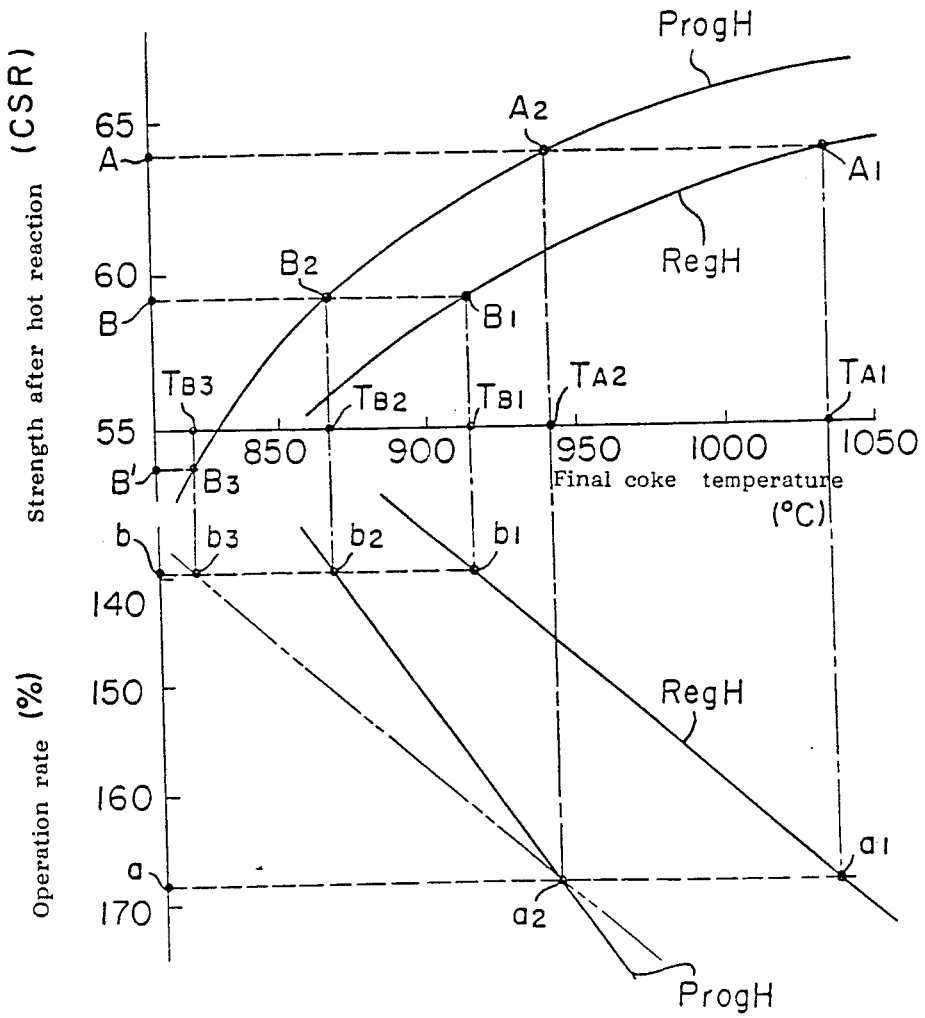
FIG. 3 is a graph illustrating the relation between the final coke temperature (i.e. the temperature of the coke to be withdrawn from the oven) and the coke strength after reaction (CSR) of the coke thereby obtained, and the relation between the operation ratio and the final coke temperature.

As shown in FIG. 3, the final coke temperature and the coke strength after reaction (CSR) are largely dependent on the operation ratio x of the coke oven as represented by the formula:

$$x = \frac{24\ (\text{hr})}{\text{Total carbonization time (hr)}} \times 100(\%)$$

Accordingly, in the selection of a specific coal center temperature for the substantial reduction of the fuel supply rate (i.e. in the determination of a specific timing for the substantial reduction), it is preferred to take the operation ratio x of the coke oven into consideration.

Figure 4:
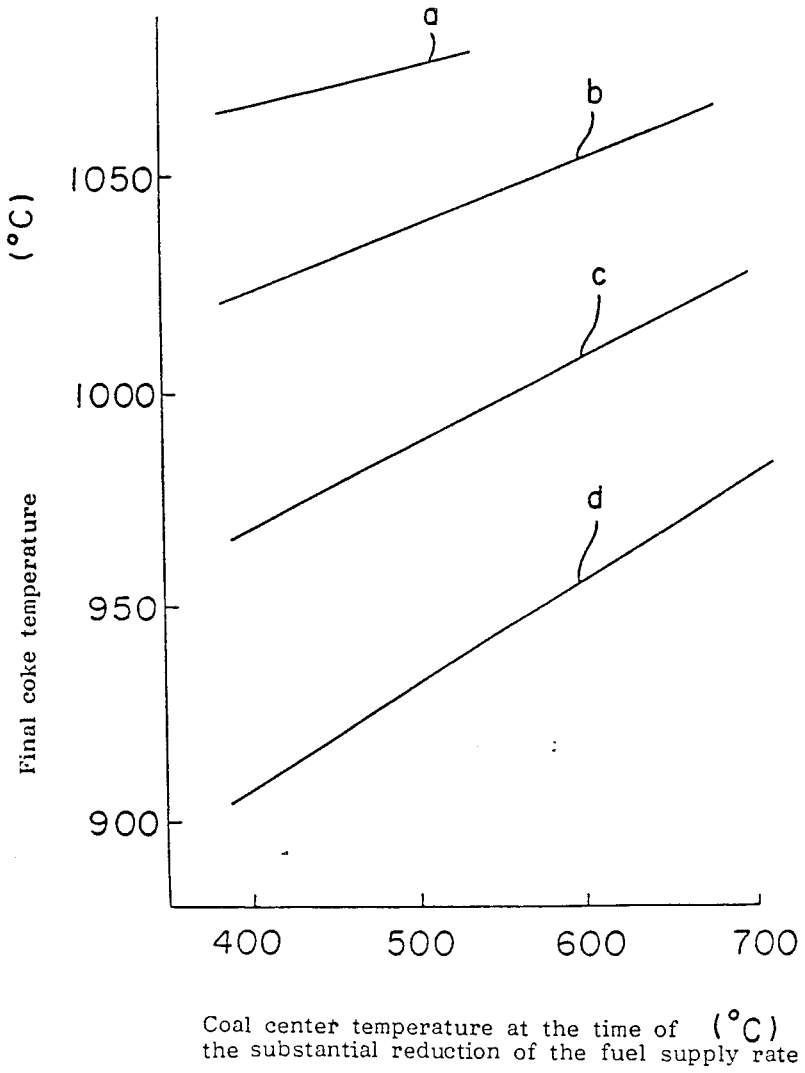
FIG. 4 is a graph illustrating the relation between the coal center temperature at the time of the substantial reduction of the fuel supply rate and the final coke temperature.

As shown in FIG. 4, in the programmed heating method (hereinafter referred to simply as Prog H), the influence of the coal center temperature at the time of the substantial reduction of the fuel supply rate over the final coke temperature, varies depending upon the operation ratio of the coke oven. In this Figure, line a represents an operation ratio of 170%, line b represents 155%, line c represents 145%, and line d represents 135%.

FIG. 3 is a graph showing the relationship between the final coke temperature and the coke strength after reaction (CSR) as well as the relation between the operation ratio and the final coke temperature, when the carbonization test was conducted by means of a test oven ($400^W \times 600^L \times 600^H$ mm) under such conditions as the amount of coal fed: about 120 kg; the water content of the coal: 9% by weight; and the bulk density of the coal: 0.78 kg/l (dry base).

In FIG. 3, the final coke temperature to obtain coke having CSR at point A or B, is $TA_1$ or $TB_1$ in the case of the regular heating method (hereinafter referred to simply as Reg H), whereas in the case of Prog H, the corresponding final coke temperature is $TA_2$ or $TB_2$, thus substantially lower than that in the case of Reg H. However, the relation between the final coke temperature and CSR is not linear, and the reduction rate of CSR at the lower temperature side of the final coke temperature is greater in the case of Prog H than in the case of Reg H. Accordingly, in the case b where the operation ratio is small, if Prog H is conducted at the same heat consumption as in the case a where the operation ratio is big, the final coke temperature will be $TB_3$, whereby CSR of the coke thereby obtainable will be B' which is substantially smaller than the desired level of B.

Accordingly, in order to maintain, as the quality of the coke obtainable in the operation of Prog H, the same level of CSR as in the case of Reg H, it is necessary to supply fuel so that the reduction rate of the heat consumption relative to Reg H decreases as the operation ratio lowers. Namely, referring to FIG. 3, Prog H should be conducted along the line connecting $a_2$ and $b_2$ rather than along the line connecting $a_2$ and $b_3$, relative to Reg H represented by the line connecting $a_1$ and $b_1$. Therefore, taking into consideration these points and a point that the final coke temperature attributable to the coal center temperature at the time of the substantial reduction of the fuel supply rate varies depending on the operation ratio, as shown in FIG. 4, it is advisable that in conducting the substantial reduction of the fuel supply rate when the coal center temperature has reached a level of from 350° to 700° C., the coal center temperature is selected, depending upon the operation ratio, from the high temperature side within said temperature range when the operation ratio is low and from the low temperature side within said temperature range when the operation ratio is high.

Namely, the coal center temperature t(°C.) at the time of conducting the substantial reduction of the fuel supply rate is preferably selected within a range to satisfy the conditions:

$$t \leqq -3.65x + 1210 \quad \text{(i)}$$

when the operation ratio x of the coke oven as represented by the formula:

$$x = \frac{24\ (\text{hr})}{\text{Total carbonization time (hr)}} \times 100(\%)$$

is at least 140%, and $$t \geqq -3.65x + 915 \quad \text{(ii)}$$

when the operation ratio x as defined above is at most 155%.

Thus, it is preferred to select the coal center temperature at the time of the substantial reduction of the fuel supply rate within the range to satisfy the above conditions (i) and (ii) in view of the relation with the operation ratio. However, except for a special case, the operation ratio is usually within a range of from 100 to 200%. Accordingly, the coal center temperature t(°C.) at the time of the substantial reduction of the fuel supply rate is more preferably selected within the range defined by a line connecting points C, D, E, F, G, H and C, especially within the range defined by a line connecting points C', D, E, F', G, H and C', in FIG. 5, i.e. within a range to satisfy the conditions:

$$t \leqq -5.00x + 1400 \quad \text{(iii)}$$

when the operation ratio x is within a range of from 140 to 200%, and $$t \geqq -5.10x + 1140 \quad \text{(iv)}$$

when the operation ratio x is within a range of from 100 to 155%.

Figure 5:
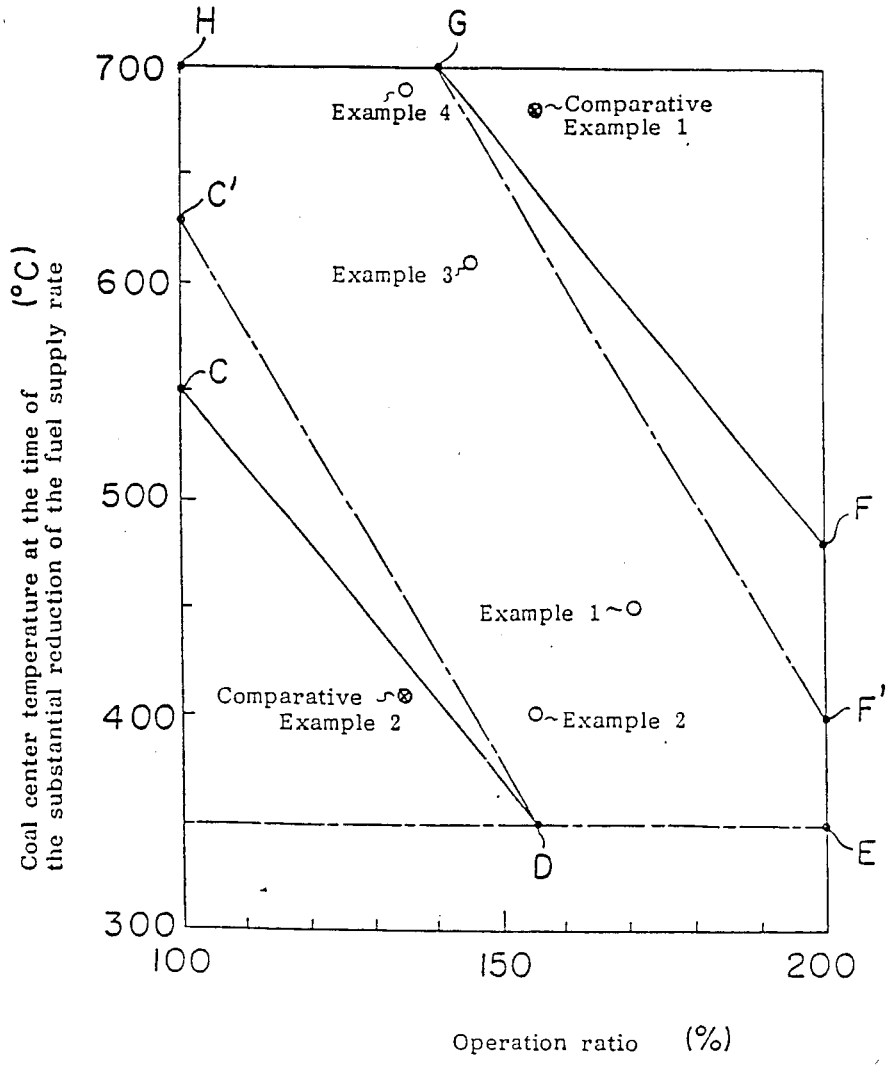
FIG. 5 is a diagram showing the range within which the coal center temperature should be selected depending upon the operation ratio.

FIG. 5 shows a diagram illustrating the relationship between the operation ratio and the coal center temperature. In the area below the line connecting points C, D and E in the Figure, CSR of the coke obtained, is not adequate, and in the area above the line connecting points F, G and H, the reduction rate of the heating consumption tends to be low, whereby the merit of the programmed heating will be lost.

The timing for the substantial reduction of the fuel supply rate may be determined by measuring the temperature each time by inserting a temperature measuring device such as a thermocouple, into the coal. However, it is practically preferred to employ a method wherein the relation between the time for the carbonization and the coal center temperature is preliminarily obtained under a representative carbonization condition, and the timing for the substantial reduction of the fuel supply rate is determined by the time passed since the initiation of the carbonization by correcting said relation depending upon the variation of the carbonization condition.

Once the fuel supply rate has been reduced from the large flow rate to the small flow rate inclusive of a zero rate, the heating is continued by a method wherein the same state will be maintained until about 0.5 to 1.5 hours prior to the next feeding, or by a method wherein the substantial reduction between the large flow rate and the small flow rate inclusive of a zero rate, is repeated twice or more times in a pulse fashion. However, the method wherein the same state is maintained, is preferred, since the operation is thereby simple and the control of the temperature of the coke oven will be easy.

By such a heating method, the carbonization of coal proceeds swiftly as is evident from the Examples given hereinafter. After the fire has been extinguished, the discharge operation is conducted. However, it is preferred to switch the fuel supply rate again to the above-mentioned large flow rate in order to raise the temperature of the oven wall of the carbonization chamber in preparation for the next feeding of coal. The timing of this substantial reduction is usually from 0.5 to 1.5 hours prior to the discharge of coke so that the temperature will reach the predetermined level at the time of the next feeding.

The determination of the fire extinction may be conducted by measuring the coal center temperature. However, it is usually conducted by the observation of the color of the gas generated from the carbonization chamber, or by the inspection of the temperature or the composition of the generated gas in an up-rising tube.

As described in detail in the foregoing, according to the present invention, the rate of temperature rise in the softening and melting temperature range in the process of the carbonization of coal can be increased by such a simple operation that the substantial reduction of the fuel supply rate in the programmed heating method is conducted in a specific timing depending upon the operation ratio of the coke oven, as will be evident from the Examples given hereinafter, whereby the softening and melting properties of the coal or the fluidity of the coal during the carbonization will be improved, and as a result, coke having high strength after reaction will be obtained and the time for fire extinction will be shortened. Besides, heat consumption can be reduced by about 10%. Thus, this method is extremely useful for an efficient process for the production of coke.

Now, the present invention will be described in further detail with reference to Examples. However, it should be understood that the present invention is by no means restricted by these specific Examples.

The physical property values given in these Examples were measured by the following methods.

| (1) Characteristics of the feed coal | |
|---|---|
| Ash content (Ash): | JIS M 8812 |
| Volatile matter (VM): | JIS M 8812 |
| Gieseler fluidity (FI): | JIS M 8801 |
| Average reflectance (Ro): | JIS M 8816 |
| Total sulfur content (Sul): | JIS M 8813 |
| Total inert (TI): | JIS M 8816 |
| (2) Coke strength after reaction (CSR) | |
| Sample grain size: | 20 mm ± 1 mm |
| Sample weight: | 200 g/time |
| Gas composition: | $CO_2$ (100%) |
| Gas flow rate: | 5 Nl/min. |
| Reaction temperature: | 1100° C. |
| Reaction time: | 120 minutes |
| Strength: | % by weight of the grains remaining on a sieve of 10 mm after 600 rotations (20 rpm × 30 min.) in an I-type drum |
| (3) Cold drum strength ($DI_{15}^{30}$) | |
| JIS K 2151 | |

EXAMPLE 1 AND COMPARATIVE EXAMPLES 1 AND 2

Figure 1:
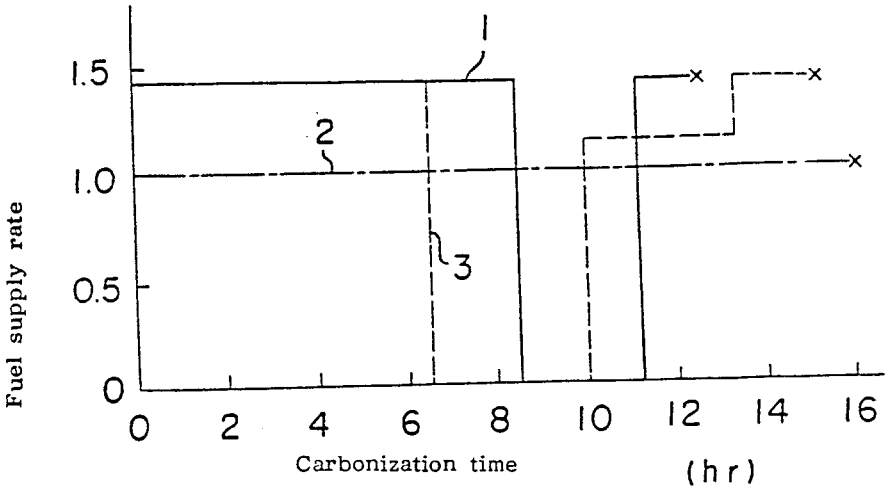

A blended coal having such characteristics as shown in Table 1 was fed into a carbonization chamber having a width of 400 mm, a length of 12.8 m and a height of 4.5 m, and a thermocouple protected by a protecting tube was inserted through an inserting hole to the center of the coal thereby packed. Carbonization was conducted in the three heating patterns as shown in FIG. 1 by using coke oven gas as fuel. In FIG. 1, the abscissa represents the carbonization time (hr) and the ordinate represents the fuel supply rate. Pattern 1 (solid line) represents a method wherein the fuel supply was switched to zero when the coal center temperature reached 540° C. and again switched to the large flow rate 1.3 hours prior to the discharge of coke. Pattern 2 (alternate long and short dash line) represents a regular heating method in which the supply rate of fuel is constant. Pattern 3 (dotted line) represents a method wherein the fuel supply rate was switched to zero upon expiry of 6.5 hours after the initiation of carbonization, then switched to a level of 1.2 times the supply rate in the case of the regular heating method, upon expiry of 10 hours and finally switched to the initial flow rate upon expiry of 13 hours.

Figure 2:
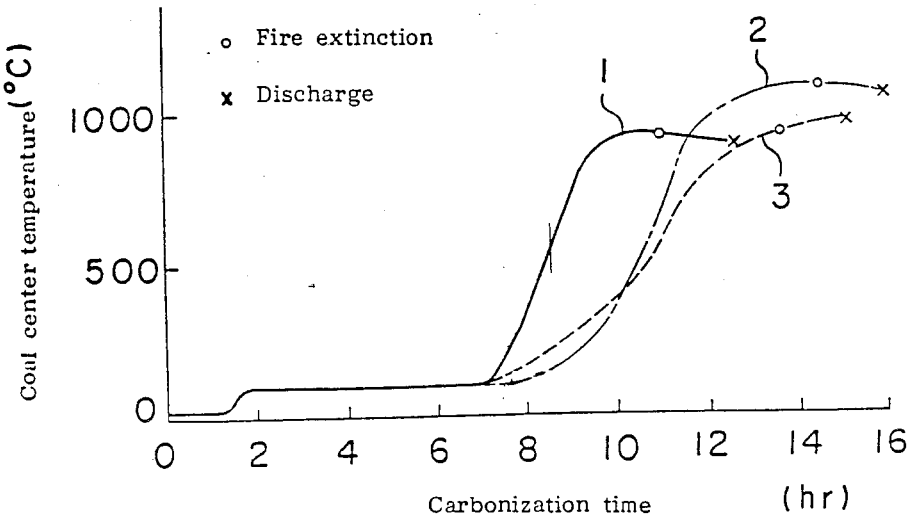
FIG. 2 is a graph illustrating the results of the measurement of the coal center temperature with respect to the heating patterns shown in FIG. 1.

During the carbonization, the coal center temperature was measured. The results thereby obtained are shown in FIG. 2. In FIG. 2, the abscissa represents the time corresponding to the carbonization time (hr) shown in FIG. 1, and the ordinate represents the coal center temperature (°C.). The solid line 1, the alternate long and short dash line 2 and the dotted line 3 correspond to the respective lines in FIG. 1.

The carbonization was conducted in such manners. In each case, the fire extinction was determined by the observation of the color of flame and the state of the generated gas, and coke was discharged upon expiry of 1.5 hours after the fire extinction. The average grain size, the cold drum strength and the strength after reaction of the coke thereby obtained were measured. The results thereby obtained are shown in Table 2. Further, the rate of the temperature rise during the period in which the coal center temperature rose from 400° C. to 500° C., the final coke temperature, the fire extinction time and the reduction rate of the fuel consumption relative to the regular heating method, are also shown in Table 2.

As is evident from Table 2, the present invention is superior to the conventional method in the fire extinction time, the fuel consumption (i.e. the reduction rate of the fuel consumption) and the coke strength after reaction.

EXAMPLES 2 TO 5 AND COMPARATIVE EXAMPLES 3 TO 5

Carbonization was conducted in the same manner as in Example 1 under the seven different conditions as shown in Table 3 in accordance with the same heating patterns as patterns 1 and 2 shown in FIG. 1.

The results thereby obtained are shown in Table 3. In FIG. 5, the operation ratio and coal center temperature of each Example were indicated by a symbol ○, and those of each Comparative Example were indicated by a symbol ⊗.

TABLE 1

| Ash (%) | VM (%) | Su (%) | FI (log ddpm) | Ro | TI (%) |
|---|---|---|---|---|---|
| 8.80 | 26.95 | 0.58 | 1.89 | 1.15 | 27.3 |

TABLE 2

| | Carbonization conditions | | | | Qualities of coke | | |
|---|---|---|---|---|---|---|---|
| | Rate of temperature rise (°C./mm) | Final coke temperature (°C.) | Fire extinction time (hr) | Reduction rate of fuel consumption (%) | Cold drum strength ($DI^{30}_{15}$) | Coke strength after reaction (CSR) | Average grain size (mm) |
| Pattern 1 | 5.56 | 900 | 11.0 | 12.2 | 92.4 | 63.3 | 50.0 |
| Pattern 2 | 4.17 | 1050 | 14.6 | — | 92.5 | 57.7 | 51.3 |
| Pattern 3 | 2.50 | 970 | 13.7 | 1.8 | 92.4 | 52.4 | 51.6 |

Notes:
[1]The rate of temperature rise is a value for the rise of the coal center temperature from 400 to 500° C.
[2]The reduction rate of fuel consumption is a value relative to pattern 2.

TABLE 3

| | | Operation ratio of the coke oven (%) | Coal center temperature at the time of the first switching of the fuel supply rate (°C.) | Final coke temperature (°C.) | Qualities of coke: Strength after reaction CSR | Qualities of coke: Drum strength $DI^{30}_{15}$ | Qualities of coke: Average grain size (mm) | Reduction rate of the heat consumption for carbonization (%) |
|---|---|---|---|---|---|---|---|---|
| Pattern 1 | Example 1 | 170 | 450 | 1070 | 62.5 | 92.7 | 53.1 | 16.4 |
| | Example 2 | 155 | 400 | 1020 | 61.1 | 92.8 | 54.1 | 12.5 |
| | Example 3 | 145 | 610 | 1010 | 61.2 | 92.9 | 54.1 | 9.4 |
| | Example 4 | 135 | 690 | 980 | 60.8 | 92.8 | 54.2 | 6.5 |
| | Comparative Example 1 | 155 | 680 | 1060 | 61.4 | 92.9 | 53.3 | 6.8 |
| | Comparative Example 2 | 135 | 410 | 910 | 57.1 | 92.5 | 54.6 | 10.3 |
| Pattern 2 | Comparative Example 3 | 155 | — | 1050 | 57.8 | 92.5 | 51.3 | — |

The reduction rate of the heat consumption for carbonization represents a percentage value relative to the usual regular heating at the same operation rate.

What is claimed is:

1. A method of controlling the addition of fuel to a coke oven by a programmed heating method in which the fuel supply rate is changed at least once during the coal carbonization process in the coke oven, comprising:

measuring the temperature of the coal packed into the carbonization chamber of the oven at its center as the coke oven is heated; and substantially reducing the rate of supply of fuel from a large flow rate during the initial stages of the carbonization process to a small flow rate, which rate includes a rate of zero supply of the fuel, for the first time when the center temperature of the coal being coked satisfies the conditions of:

(i) the temperature within the coal bed ranges from 350° to 700° C., (ii) $t \leqq -3.65x + 1210$, where the operation ratio x of the coke oven is represented by the formula:

$$x = \frac{24\ (\text{hr})}{\text{total carbonization time (hr)}} \times 100\%$$

is at least 140%, and (iii) $t \geqq -3.65x + 915$, where the operation ratio x is as defined above and is at most 155%.

2. The method according to claim 1, wherein the temperature t(°C.) at the center of the coal bed in the coke oven at the time during which the rate of fuel supplied to the coke oven is substantially reduced is within the range which satisfies the conditions:

(i) $t \leqq -5.00x + 1400$, where the operation ratio x is as defined in claim 9 and is within the range of 140% to 200%, and (ii) $t \geqq -5.10x + 1140$, where the operation ratio x is as defined in claim 1 and is within the range of from 100 to 155%.

3. The method of controlling fuel for a coke oven according to claim 1, wherein the operation ratio x as defined above is within a range of 100 to 200%.

4. The method of controlling fuel for a coke oven according to claim 1, wherein the substantial reduction of the fuel supply rate is conducted when the coal center temperature t(°C.) is within a range of from 400° to 650° C.

5. The method of controlling fuel for a coke oven according to claim 3, wherein the substantial reduction of the fuel supply rate is conducted when the coal center temperature t(°C.) is within a range of from 400° to 650° C.

6. The method of controlling fuel for a coke oven according to claim 2, wherein the substantial reduction of the fuel supply rate is conducted when the coal center temperature t(°C.) is within a range of from 400° to 650° C.

* * * * *